US009598747B2

(12) United States Patent
Lampson et al.

(10) Patent No.: US 9,598,747 B2
(45) Date of Patent: Mar. 21, 2017

(54) SYSTEM AND METHOD OF MELTING RAW MATERIALS

(71) Applicant: Retech Systems LLC, Ukiah, CA (US)

(72) Inventors: Robin A. Lampson, Ukiah, CA (US); Robert E. Haun, Healdsburg, CA (US); Paul G. Meese, Windsor, CA (US); Matthew A. Charles, Cloverdale, CA (US); Edward C. Strout, Ukiah, CA (US); Todd R. Telfer, Ukiah, CA (US)

(73) Assignee: RETECH SYSTEMS LLC, Ukiah, CA (US)

( * ) Notice: Subject to any disclaimer, the term of this patent is extended or adjusted under 35 U.S.C. 154(b) by 655 days.

(21) Appl. No.: 14/031,008

(22) Filed: Sep. 18, 2013

(65) Prior Publication Data

US 2014/0182416 A1 Jul. 3, 2014

Related U.S. Application Data

(60) Provisional application No. 61/702,726, filed on Sep. 18, 2012.

(51) Int. Cl.
*C22B 4/00* (2006.01)
*C22B 4/08* (2006.01)
(Continued)

(52) U.S. Cl.
CPC ..... *C22B 4/005* (2013.01); *B22D 41/01* (2013.01); *B22D 41/04* (2013.01); *C22B 4/08* (2013.01);
(Continued)

(58) Field of Classification Search
CPC ..... B22D 41/04; B22D 41/01; C22B 9/226; C22B 9/20; C22B 4/005; H05B 7/20
See application file for complete search history.

(56) References Cited

U.S. PATENT DOCUMENTS 3,173,981 A 3/1965 Myers
3,554,522 A * 1/1971 Herrmann ..... B22D 18/06 266/208
(Continued)

FOREIGN PATENT DOCUMENTS

EP 0273975 A1 7/1988
JP 2001-019593 A 1/2001
(Continued)

OTHER PUBLICATIONS

Moskvichev et al. RU 2346221 C1 published Feb. 2009. Machine translation.*
(Continued)

*Primary Examiner* — George Wyszomierski
*Assistant Examiner* — Tima M McGuthry Banks
(74) *Attorney, Agent, or Firm* — Kilpatrick Townsend & Stockton, LLP

(57) ABSTRACT

A system and method for melting a raw material. The raw material is fed into an electrically conductive vessel. A plasma arc torch melts at least some of the raw material within the vessel to thereby create a molten material. An inductor, physically disposed adjacent the vessel, and electrically disposed in series with the vessel in operation, effects electromagnetic stirring of the molten material by interacting with the current of the plasma arc torch.

29 Claims, 11 Drawing Sheets

(51) Int. Cl.

| | |
|---|---|
| ***B22D 41/01*** | (2006.01) |
| ***B22D 41/04*** | (2006.01) |
| ***F27D 11/12*** | (2006.01) |
| ***H05B 7/20*** | (2006.01) |
| ***F27B 5/06*** | (2006.01) |
| ***F27B 5/14*** | (2006.01) |
| ***F27D 27/00*** | (2010.01) |
| *F27D 99/00* | (2010.01) |
| *F27D 3/00* | (2006.01) |

(52) U.S. Cl.
CPC ..... *F27B 5/06* (2013.01); *F27B 5/14* (2013.01); *F27D 11/12* (2013.01); *F27D 27/00* (2013.01); *H05B 7/20* (2013.01); *F27D 2003/0083* (2013.01); *F27D 2099/0031* (2013.01)

(56) References Cited

U.S. PATENT DOCUMENTS

| | | | | |
|---|---|---|---|---|
| 3,944,412 | A * | 3/1976 | Liu | C22B 9/226 219/121.36 |
| 4,940,486 | A | 7/1990 | Sommerville | |
| 6,006,821 | A | 12/1999 | Haun et al. | |
| 2003/0150374 | A1 * | 8/2003 | Sasatani | C30B 29/06 117/50 |
| 2004/0056394 | A1 * | 3/2004 | Jackson | B22D 11/11 266/216 |
| 2005/0175063 | A1 | 8/2005 | Roberts et al. | |
| 2008/0298425 | A1 * | 12/2008 | Jackson | F27B 14/04 373/108 |

FOREIGN PATENT DOCUMENTS

| | | | |
|---|---|---|---|
| JP | 2007-024396 | A | 2/2007 |
| KR | 10-2012-0031421 | A | 4/2012 |
| RU | 2346221 | C1 * | 2/2009 |

OTHER PUBLICATIONS

SU 432320 A published Apr. 1975. Machine translation.*
International Search Report and Written Opinion mailed Dec. 10, 2013 in Int'l Patent Application No. PCT/US2013/060477, 13 pages.
Extended EP Search Report, received by the European Patent Office in application No. 13838299.9; 8 pages.

* cited by examiner

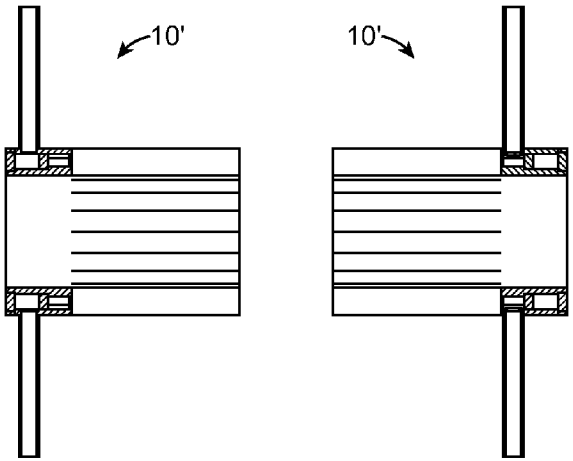
FIG. 5A
FIG. 5B
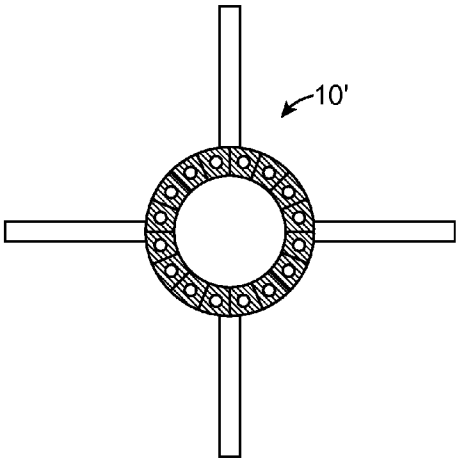
FIG. 5C
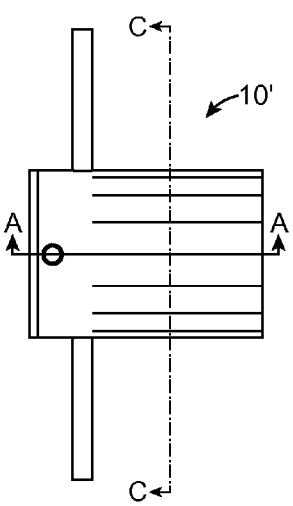
FIG. 5D
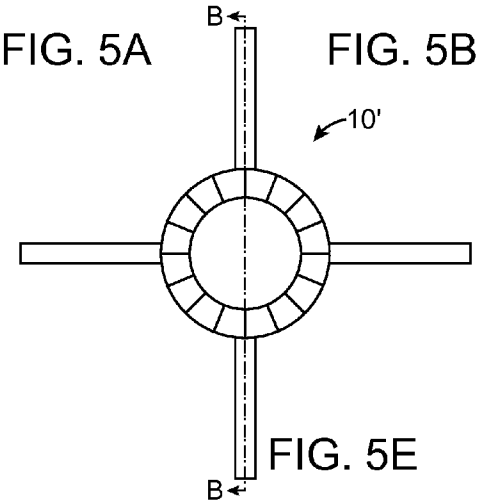
FIG. 5E
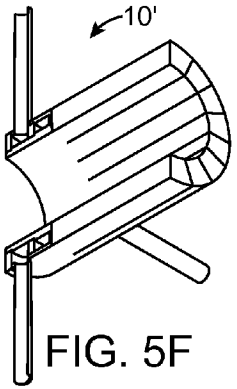
FIG. 5F
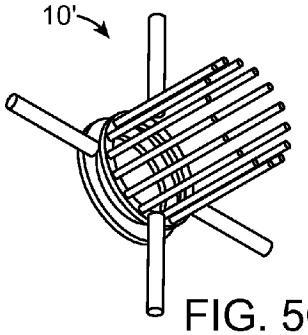
FIG. 5G

SYSTEM AND METHOD OF MELTING RAW MATERIALS

CROSS-REFERENCE TO RELATED APPLICATION

This application claims priority to, and the benefit of, U.S. Provisional application 61/702,726, filed Sep. 18, 2012, the disclosure of which is hereby incorporated by reference.

BACKGROUND OF THE INVENTION

This invention relates to a system and method of melting raw materials, such as reactive metals, e.g. titanium, zirconium, nickel, cobalt, and their alloys. The molten material can subsequently be used to form ingots or castings. The invention is presently considered especially useful for forming small cross-sectional ingots, and/or ingots or castings that will later be converted into powder, where homogeneity of each granule of powder is of particular concern.

Small cross-sectional bars and castings of these metals are used throughout the aerospace, automotive, energy, and medical industries. They can be machined or forged into any number of shapes. They may be used as the feedstock to be drawn into wire.

Such bars are typically made from larger ingots which are incrementally heated to high temperatures and then forged down into the desired size. The forging process can lead to considerable yield loss—a 60-70% yield of usable metal is typical. This is mainly due to deformation of the ends of the ingot after a number of forging steps. In addition, it can take months for an ingot to await its turn in the queue to be forged. Still further, due to the relatively small surface area to volume ratio of the large ingots and associated cooling rates, the grain size of the finished product may be larger than desired.

For all these reasons, it is desirable to cast the ingots nearer to their desired final cross-sectional size, a feat which has heretofore not been accomplished for small cross-sectional ingots.

It is also desirable to ensure that the ingots are as homogeneous as possible, for reasons that will be apparent to those of ordinary skill in the art.

Furthermore, parts made from powdered metals are increasingly common. The powder is usually formed by grinding, or by remelting and atomizing, an ingot or casting that has been cast from a molten material. The parts can then be produced by consolidating the powder either directly into a final shape, or into a preform that is then machined. In most uses, it is usually very important that each powder particle be of the same composition. This can only be achieved by ensuring that the metal ingot or casting from which the powder is formed is homogeneous, which can in turn only be achieved if the molten metal from which the ingot or casting is made is homogeneous.

The most common method of ensuring homogeneity in the molten metal is to stir the molten metal. Another method, which is mentioned in U.S. Pat. No. 6,006,821 to Haun et al., dated Dec. 28, 1999, and assigned to the Applicant herein, uses an induction coil. It should be noted that the induction coil disclosed therein is powered separately from the plasma arc torch using an additional power source. U.S. Pat. No. 6,006,821 to Haun et al. is hereby incorporated by reference.

Metals such as titanium, zirconium, nickel, cobalt, and their alloys can be contaminated by the oxide refractories used to make induction furnaces. Therefore, these metals are typically melted in segmented water-cooled copper vessels, with an associated induction coil and its separate power source. However, this melting technique is only about 25% efficient thermally.

Other methods of melting metals to thereby form ingots are known in the art.

BRIEF SUMMARY OF THE INVENTION

Raw material is fed into an electrically conductive vessel. A plasma arc torch melts at least some of the raw material within the vessel to thereby create a molten material. An inductor, physically disposed adjacent the vessel, and electrically disposed in series with the vessel in operation, effects electromagnetic stirring of the molten material by interacting with the current of the plasma arc torch.

In some embodiments, the inductor is not connected to any additional power source.

A switch may further be provided, and be operable to switch the system between a first configuration in which the inductor is in series with the vessel, and a second configuration in which the inductor is electrically bypassed and is not in series with the vessel.

The power supply may be a direct current power supply, an alternating current power supply, or both. The plasma arc torch may use direct current, alternating current, or a simultaneous combination of both to melt the material.

An actuator may be provided to tilt the vessel between a first position, for receiving the raw material and having it melted therein, and a second position, for pouring at least some of the molten material out of the vessel. The molten material may be poured into a receptacle such as a mold. The mold may include a heated, upper portion, where the molten material is maintained in molten form, and a lower portion maintained at a temperature at which the molten material solidifies to thereby form an ingot.

The raw material may be fed into the vessel in batches, and poured out of the vessel in additional batches. The raw material may be fed into the vessel with a feeder, such as a bar feeder, a bulk feeder, a hopper, or a canister.

The raw material may be a reactive metal such as titanium, zirconium, nickel, cobalt, or combinations or alloys thereof, and may be in the form of compacted disks, cylinders, blocks, loose material wrapped in foil, unwrapped loose material, or scrap pieces of the raw material.

BRIEF DESCRIPTION OF THE DRAWINGS

Exemplary embodiments will be described in more detail with reference to the accompanying drawings, in which:

FIGS. 5A-5G are various schematic views of one embodiment of a water-cooled copper melting vessel.

DETAILED DESCRIPTION OF THE INVENTION

Exemplary embodiments of the present invention provide a system and method for producing a homogeneous melt from raw material in solid form. The raw material is fed into a vessel. A plasma arc torch melts at least some of the raw material within the vessel to thereby create at least a portion which is molten. An induction coil, provided around or below the vessel, is in series with the plasma arc, thereby providing electromagnetic stirring of the molten metal without the need for a separate power source. This stirring leads to superior homogeneity over that of comparable known systems.

Exemplary embodiments of the present invention also provide a system and method for producing ingots or castings, such as small cross-sectional area ingots, from raw material in solid form. In one exemplary embodiment, this is accomplished first by melting the material as described above, then pouring the molten material into any desired receptacle, such as a mold. The pouring may take place in any desired manner.

In another exemplary embodiment, the raw material is fed into a tiltable vessel in a substantially upright position. A plasma arc torch melts at least some of the raw material within the vessel to thereby create a portion which is molten, while an induction coil, provided around of below the vessel, provides electromagnetic stirring of the metal without the need for a separate power source. The vessel is then tilted to pour some of the molten material into a receptacle such as a mold to thereby form a casting or an ingot.

The invention is especially considered particularly suitable for titanium, zirconium, nickel, cobalt, and combinations and alloys thereof.

Figure 1:
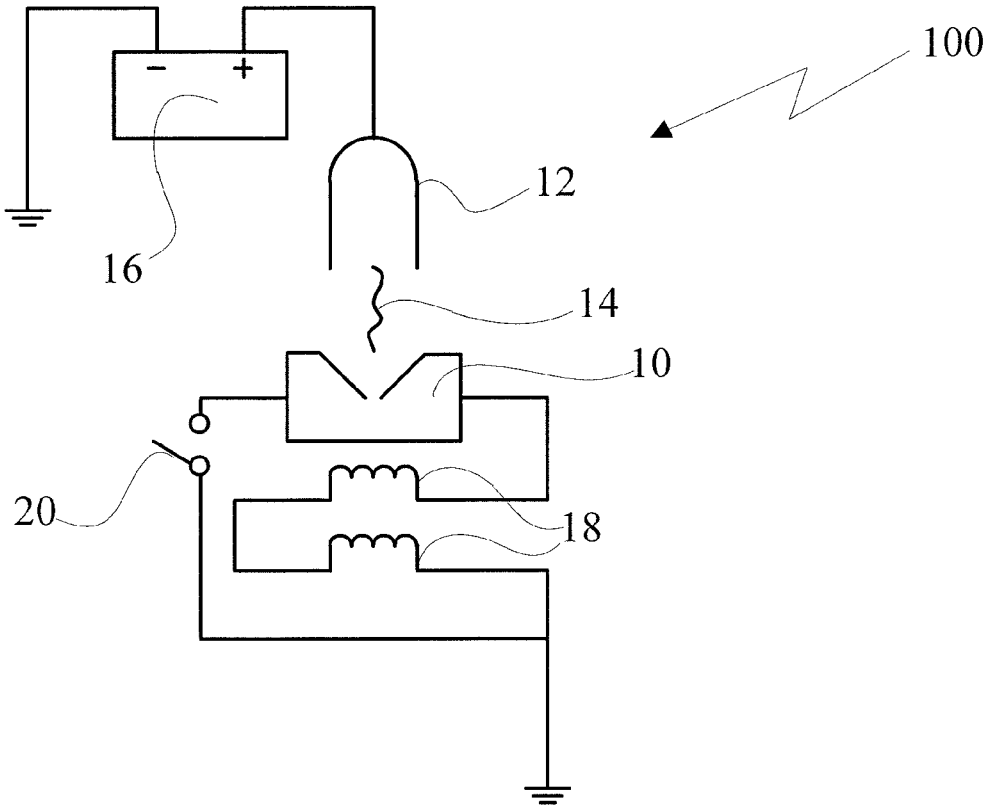
FIG. 1 is a schematic view of a system for melting raw materials.

Referring to FIG. 1, a system 100 for melting raw material is shown. First, raw material is prepared in discrete amounts such that its composition is within the allowable limits for the mixture or alloy desired. Common forms of raw material include compacted disks; cylinders; blocks; loose material wrapped in foil to form a ball; unwrapped loose material; and scrap pieces of the desired metal, mixture of metals, or alloy. The raw material may, however, be in any suitable form. The raw material then enters a vessel 10 by any appropriate method, such as, for example, by being pushed in by a bar feeder, dropped in by a bulk feeder, or, in the case of loose material, fed through a hopper or spoon-type canister and then dropped into the vessel 10.

Once in the vessel 10, the raw material is melted by a stationary or movable plasma arc torch 12, shown schematically as creating a plasma arc 14, and powered by a power source 16.

It will be appreciated that metals such as titanium, zirconium, nickel, cobalt, and their alloys cannot be melted in ceramic lined vessels. The molten material would react with the ceramic and become contaminated to the point of being unusable. Therefore, in one exemplary embodiment, the vessel 10 is made of copper, which is considered more suitable as a melting receptacle for melting these metals. However, because of the relative melting point of copper compared to some of the metals which may be used with the invention, it may be advantageous to cool the copper vessel. Therefore, in one exemplary embodiment, the vessel 10 is a water-cooled (or other fluid-cooled) copper vessel. Typically, the bottom surface and the sides of the vessel are water-cooled. Thus, while the top portion of the material within the vessel is molten, some amount of the material may re-solidify (or, in some cases, not melt to begin with) to form a solid skull at the bottom of the vessel. The skull may be considered undesirable, but for large quantities of material, it constitutes a small fraction of the overall processed material. As reported by the inventors herein, when melting metals such as titanium, zirconium, nickel, cobalt, and their alloys, not all of the material can be maintained molten, and this can sometimes be advantageous despite the inherent efficiency losses. Any appropriately sized and shaped vessel may be used, depending on the constraints of the system 100.

In those instances in which an alloy ingot or other casting is desired, correct melting and mixing of the raw material is crucial. The volume of the vessel 10 should thus be large enough to hold the discrete pieces of raw material while melting, as well as to effectively pre-mix the alloy and even out any small compositional variations inherent to the raw material from one piece to the next. This may be further achieved by purposely emptying the vessel on a regular basis, leaving a minimal amount of skull to avoid the build-up of higher melting point elements, components, or alloys. In presently preferred embodiments, the vessel is not used to refine the alloy, so relatively long residence times are not required.

Also shown schematically in FIG. 1 is an inductance coil or coils 18 provided underneath the vessel 10, around the vessel 10, or both. The coil or coils 18 are effectively in series with the plasma arc torch 12, and do not need to be connected to a separate power supply. In use, the return current from the plasma arc torch 12 flows through the (at least somewhat conductive) material to be melted, through the copper vessel 10, and through the induction coils 18, thus effecting efficient stirring of the metal without the need for a separate power source associated with the induction coils 18. In more detail, there is an interaction between the current carried by the plasma arc 14 and an electromagnetic field associated with the inductance coils 18. In known systems, the electromagnetic field is typically generated by a separate power supply associated with the coil. However, the present inventors have discovered that a separate power source is not needed, and that such an effect can be achieved by appropriately situating and configuring the coil or coils 18 such that the current from the plasma arc torch 12 passes through the molten metal, the vessel 10, the coils 18, then to the utility main (schematically illustrated in FIG. 1 as the ground at the bottom right of the Figure). In other words, unlike in the typical prior art, the coil or coils 18 are provided in series with the plasma arc 14.

While the term "inductor" is often used to refer to an inductor within an AC circuit, this term is not intended to be so limited. In a presently preferred embodiment, the power supply 16 is a DC power supply and the plasma arc torch 12 is configured to use direct current to melt the material. In this respect, the inductors 18 may be termed "DC coils" rather than inductors. These terms should be considered interchangeable. In other embodiments, the power supply 16 is an AC power supply or comprises both an AC and a DC power supply. A suitable plasma arc torch 12 may be selected based on the power supply 16 that is to be used, but the inventors have conceived that the inductors 18 may be used interchangeably in any AC, DC, or combination system.

A switch 20 may also be provided to turn the electromagnetic stirring on and off. In its simplest form, as shown, the switch 20 may be a single pole, single throw switch. When the switch is open, as illustrated, the induction coils 18 are effectively in series with the vessel 10 and plasma arc torch 12. When the switch 20 is closed, the vessel 10 is connected directly to ground, and the stirring is turned off.

Figure 2:
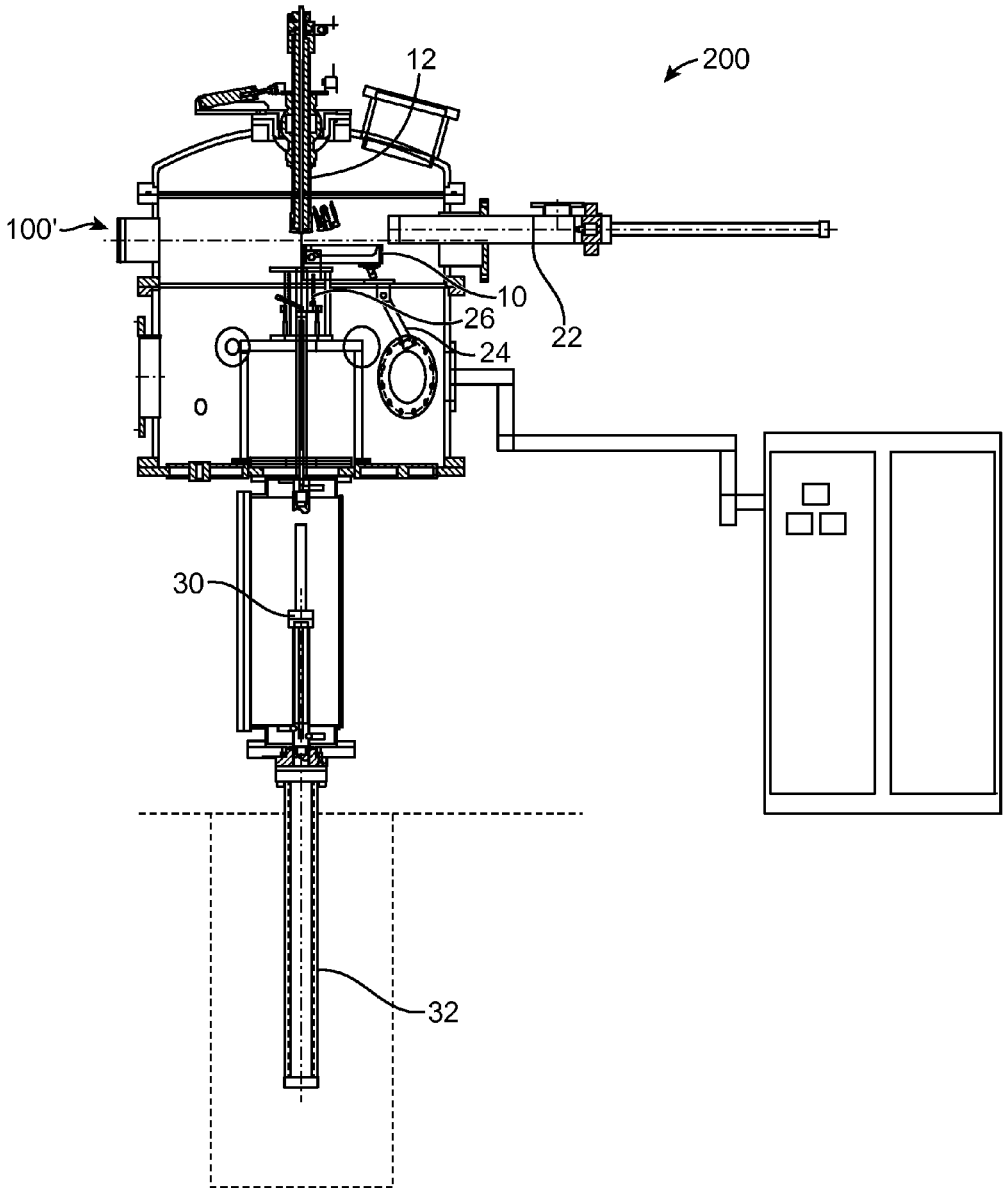
FIG. 2 is a schematic view of a system for the production of an ingot, with the vessel in the feed/melt position.

Referring to FIG. 2, a system 200 for producing a small cross-sectional ingot is shown. For ease of illustration, this system 200 uses another embodiment of the sub-system 100' for melting raw material that does not include the stirring coil 18. It should be appreciated that a melting system 100 such as is shown in FIG. 1 could be incorporated into this larger system 200 if desired. The raw material may enter the vessel 10 by any appropriate method, as was described above with reference to FIG. 1. FIG. 2 illustrates, for exemplary purposes, the material entering the vessel 10 by being pushed in by a bar feeder 24. Once in the vessel 10, the raw material is melted by a stationary or movable plasma arc torch 12. The latter is shown in FIG. 2. Referring also to FIGS. 5A-5G, in the illustrated embodiments, the vessel 10, 10' is a water-cooled (or other fluid-cooled) copper vessel. FIGS. 5A-5G show one embodiment of a water-cooled copper vessel 10' which is different in shape than that 10 illustrated in FIGS. 2-4. Any appropriately sized and shaped vessel can be used, depending on the constraints of the system.

Figure 3:
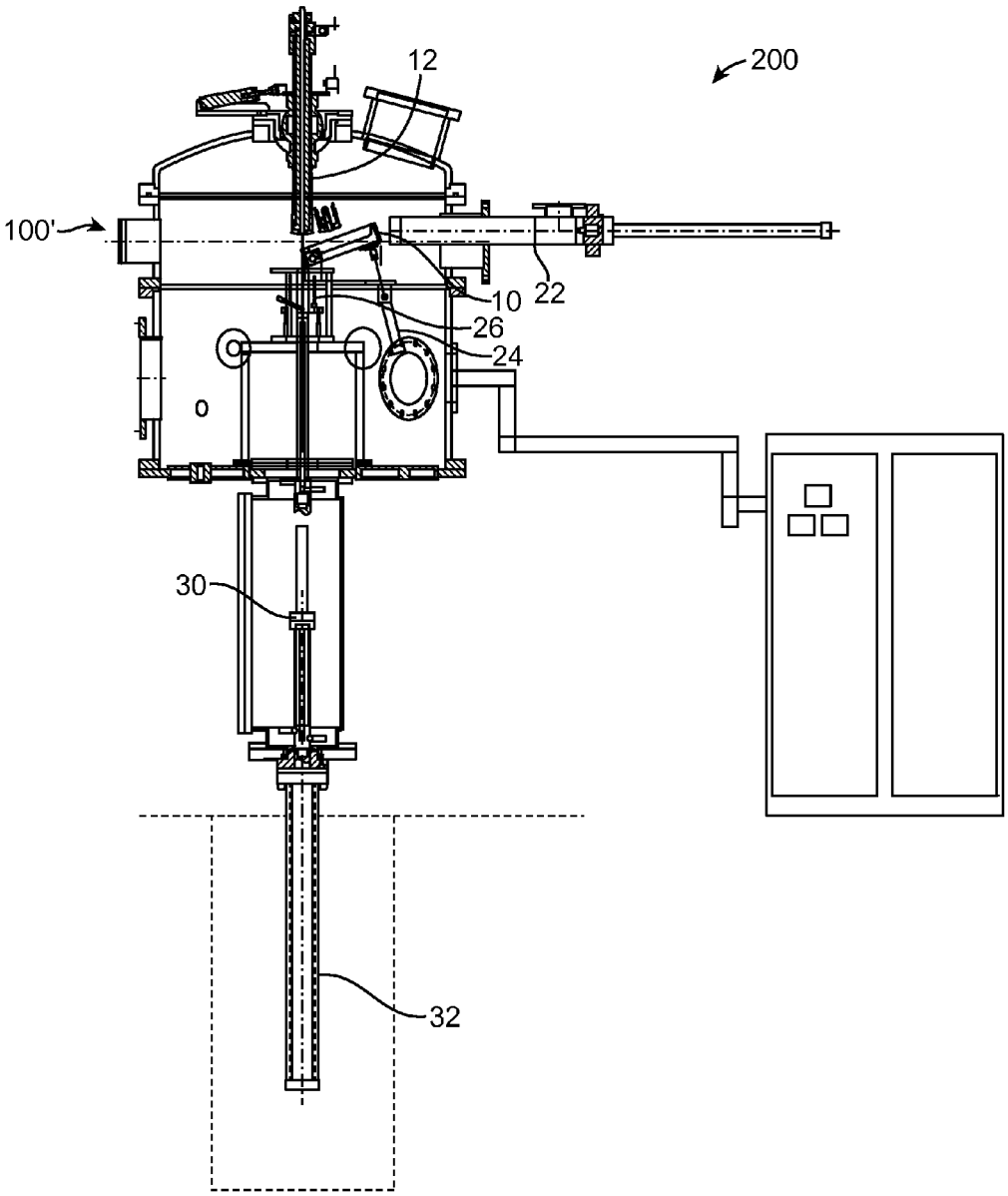
FIG. 3 is similar to FIG. 2, but shows the vessel in the pour position.
Figure 4:
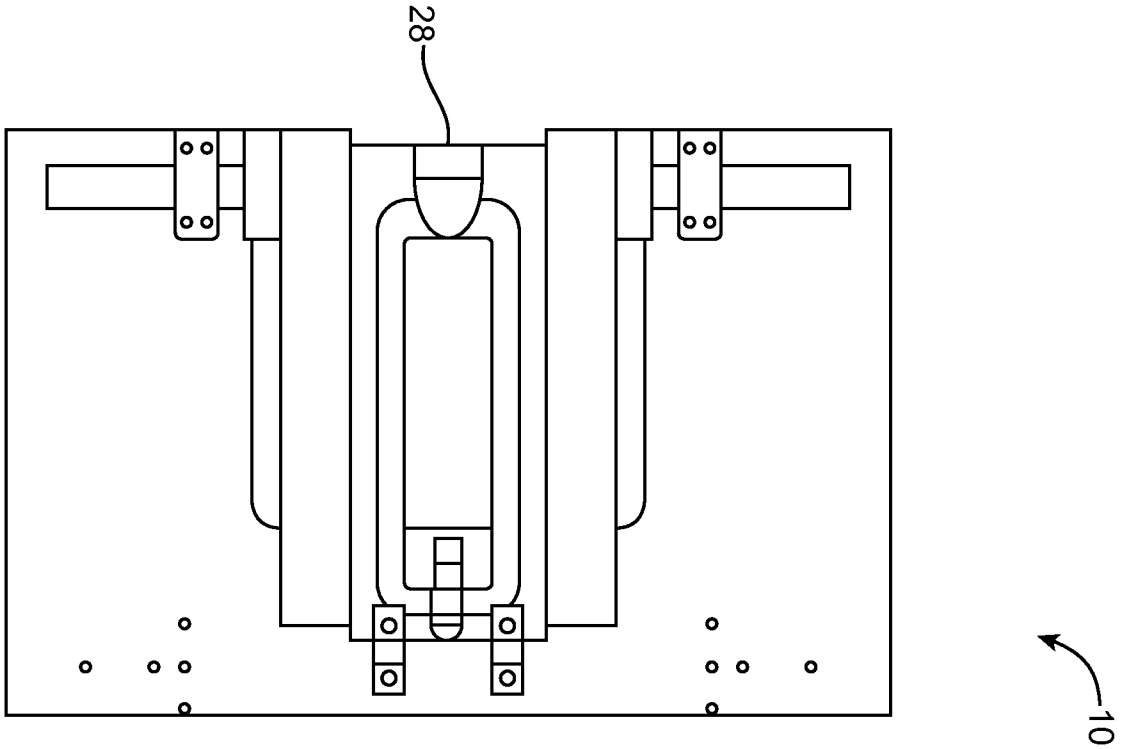
FIG. 4 is a partial top view of the vessel.

Turning now to FIG. 3, the vessel 10 is illustrated in a tilted position. Once a sufficient amount of material has melted and collected at the top of the vessel, the vessel is tilted to the position of FIG. 3 by any appropriate actuators 24 to pour a desired amount of the molten material into a mold 26. The material is poured in discrete amounts or batches, for reasons that will be described below. Referring also to FIG. 4, which illustrates a top view of the vessel 10 of FIGS. 2 and 3, the vessel 10 may include a pour notch or spout 28 through which the material is poured into the mold 26. The pour notch or spout 28 may be comparable in size to the cross-sectional area at the top of the mold 26. The movable plasma arc torch 12 or other heat source may be used to help direct the molten material through the spout 28 into the mold 26. Once the desired amount of molten material has been poured into the mold 26, the vessel 10 is re-tilted back to its upright position shown in FIG. 2, where more raw material is fed into it, and the process begins again.

In those instances in which an alloy ingot is desired, correct melting and mixing of the raw material is crucial. The volume of the vessel should thus be large enough to hold the discrete pieces of raw material while melting, as well as to effectively pre-mix the alloy and even out any small compositional variations inherent to the raw material from one piece to the next. This may be further achieved by purposely emptying the vessel on a regular basis, leaving a minimal amount of skull to avoid the build-up of higher melting point elements, components, or alloys. The vessel is not used to refine the alloy, so relatively long residence times are not required. The tilt-pouring of the vessel itself enables the rapid turnover of raw material, thereby creating a nearly homogeneous liquid, which is then delivered to the mold.

Turning now to the mold, the mold may have many different possible shapes depending upon the articles desired. Any suitable closed- or open-bottom mold may be used.

The mold may be shaped to create a specific part or parts or any preformed shape which can be converted into a part or parts. In this case, the mold may have an open top and closed bottom. Alternatively, the mold may be shaped for semi-continuous ingot production. In this case, the mold may have an open top and bottom. Any number of molds may be moved into and out of the casting position in a semi-continuous fashion.

One exemplary open-bottom mold 26 will be described. As was described above, the molten material is fed into the mold in discrete amounts or batches. Referring to FIGS. 2 and 3, a movable plug 30 may be provided to support the first amount of material. After each amount is poured, the ingot is moved downward to provide more open space at the top of the mold for the next amount of molten material to be fed therein. In other words, the ingot is either continuously or incrementally lowered within the mold, by pulling the solidified portion of the ingot out of the bottom of the mold with any suitable mechanism 32, such as a hydraulic cylinder, a movable clamp, or drive rolls.

The mold may have a segmented temperature control system, i.e. be cooled at the bottom and heated at the top, where the molten material is fed in. This maintains a certain depth of molten material above the portion of material that is in the process of solidifying at any given time. The pressure created by this molten head ensures the formation of an ingot which is free from porosity and other defects, such as solidification shrinkage voids. In addition, the constant mixing created by the heater ensures a chemically homogeneous molten pool, thereby ensuring chemical homogeneity throughout the length of the ingot. Some of the solidified material may also be re-melted by the molten head and mixed in with it, further adding to the homogeneity. The cooling within the mold may be, e.g, water cooling, and the heater may be, e.g, an induction heater. An exemplary material for the mold is copper.

The mold may be a small cross-sectional area mold. For example, for metals such as titanium, zirconium, nickel, cobalt, or combinations or alloys thereof, it has heretofore been very difficult to create ingots with cross-sectional areas of about 7.1 square inches or less (e.g. circular cross-sectional ingots with diameters of about 3.0 inches or less). For molds of this size, if a plasma arc torch were used to heat the material in the top portion of the mold, the diameter of the plasma arc would be large enough to destroy the mold itself. Therefore, an alternative heat source such as an induction coil may be used to maintain the top portion of the material within the mold in its molten state.

Additionally or alternatively, the term "small cross-sectional area" can refer to a mold of any appropriate size to accomplish any one or more of the following effects:

- avoiding cracking in the final ingot
- avoiding cracking of the ingot when it is processed during further fabrication into a finished product
- allowing controlled cooling while the ingot solidifies
- producing an ingot with any desired grain size, such as a comparatively small grain size (e.g. 100 micrometers or less)

For example, the mold may have a cross-sectional area of about 7.1 square inches or less. An exemplary ingot size is 2⅛ inches diameter by 120 inches or more long. This may be very close to the desired final size, and require only a small amount of machining to remove undesirable as-cast features related to the way the ingot solidifies and cools. Furthermore, because of the higher surface area to volume ratio and associated cooling, and because of the temperature gradients established in the ingot by the segmented (heated/cooled) mold, a typical as-cast grain size for a titanium alloy ingot is 100 micrometers or less.

However, the mold is not limited to a circular cross-section, but may have a cross-section that is polygonal, polygonal with rounded corners, or any other desired shape. Still further, the mold is not limited to a constant cross-sectional size or shape. The mold may be tapered or have other non-constant cross-sectional shapes. In such embodiments, a "small cross-sectional area" mold may be considered a mold with a cross-sectional area of about 7.1 square inches or less across any cross-section, or alternatively, a mold with a cross-sectional area of about 7.1 square inches or less across some cross-sections, and larger cross-sectional areas across others.

EXAMPLES

Example 1

Sample Operational Parameters to Make a Titanium Aluminide Alloy Ingot

Figure 6:
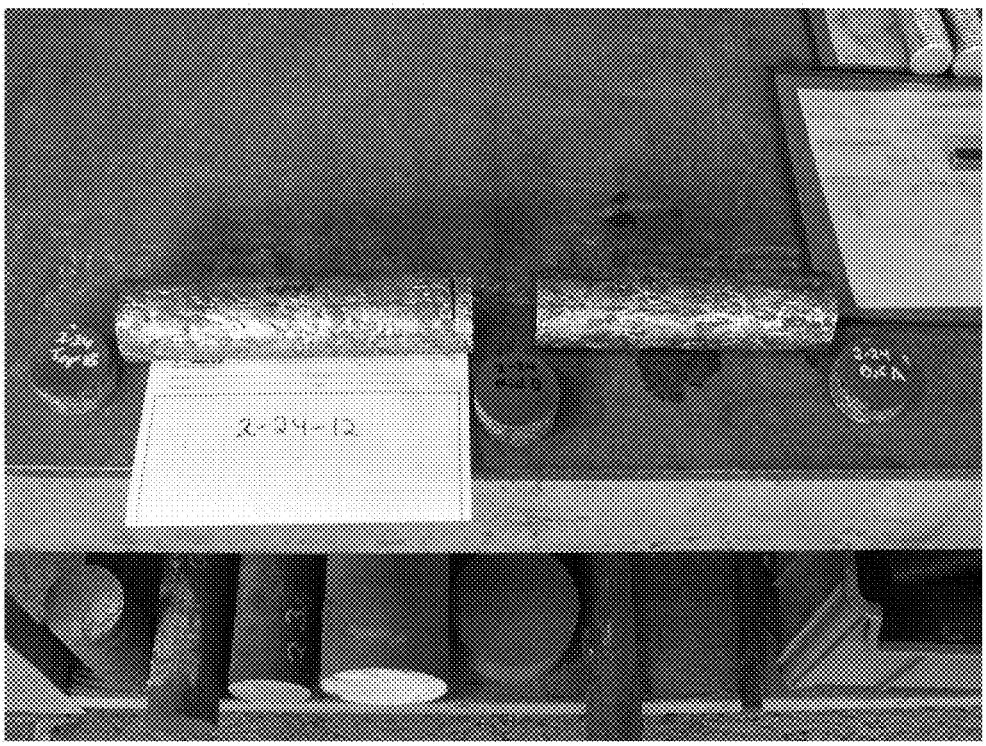
FIG. 6 is a photograph of a 55 mm outer diameter titanium aluminide ingot manufactured in accordance with one exemplary embodiment of the invention, showing transverse cuts.
Figure 7:
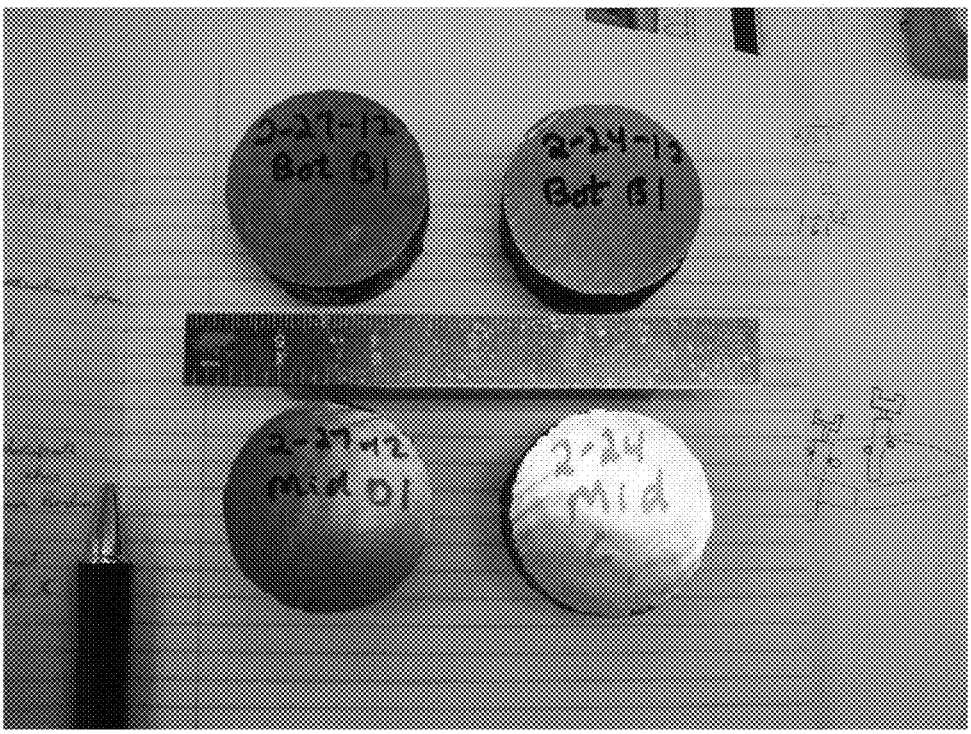
FIG. 7 is a photograph of several cross-sections of the ingot of FIG. 6.
Figure 8:
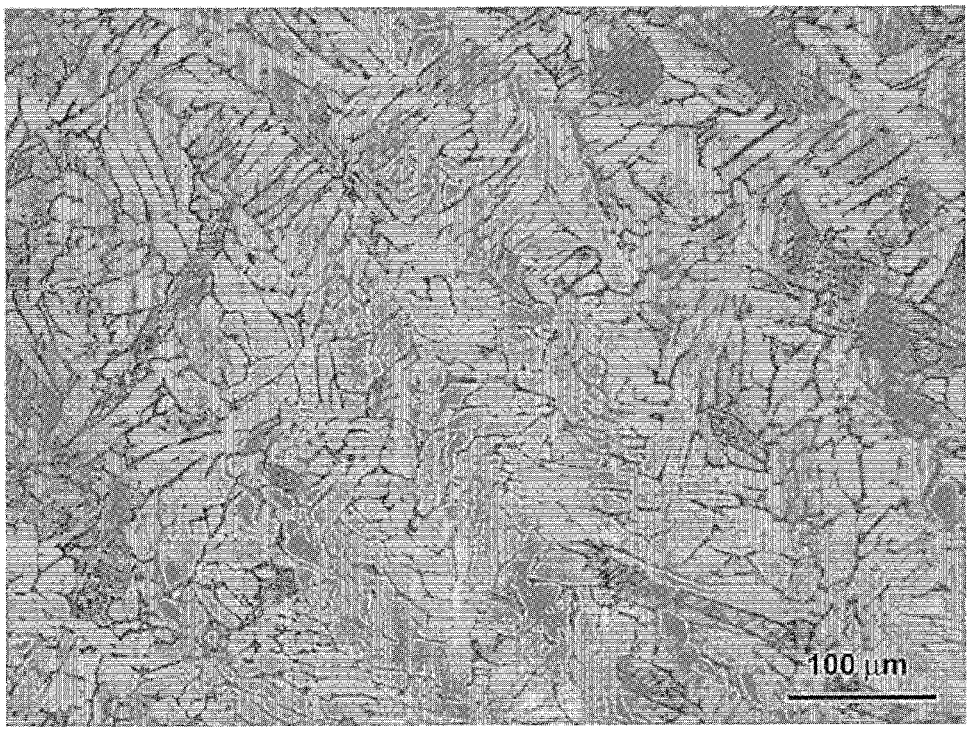
FIG. 8 is a photograph of the microstructure of the ingot of FIG. 6.

FIGS. 6-8 illustrate a 55 mm outer diameter titanium aluminide ingot manufactured in accordance with Example 1. Four inch diameter compacts were made from elemental materials: commercially pure titanium sponge, a niobium-aluminum master alloy, an aluminum-molybdenum-titanium master alloy, an aluminum-titanium-boron master alloy, and aluminum pellets. The compacts were made using a 150 ton hydraulic press. Each compact was weighed out such that the constituents formed the exact final alloy composition. The mass of each compact was 1.050 kg. About seven compacts were placed in the feeder of the Retech PAM-5 (plasma arc melting) system. Four compacts were placed in the vessel to create the skull. The chamber pumped down to less than 50 mTorr pressure with a rate-of-rise less than 5 mTorr/min. The chamber was back-filled with helium to about 600 Torr and the plasma arc torch started on the compacts placed in the vessel. The contents within the vessel were melted using between 600-700 Amp torch current and then the vessel was moved into the pouring position while the plasma arc torch was still operating. The molten contents of the vessel were poured into a 55 mm inside diameter water-cooled copper segmented mold. A water cooled copper plate with a dovetail groove machined into it formed the bottom of the mold. The molten material poured into the mold was allowed to solidify in the dovetail thereby creating the means to pull the solidified ingot out of the mold upon subsequent pours. Once the initial casting of the dovetail was completed, the induction power supply to the mold was turned on to about 80 kW. A second pour from the vessel was made to fill the mold to the level where a molten pool could be maintained using the induction power. The vessel was moved to the feed position, and a compact was pushed into the vessel from the feeder. This compact was melted quickly by the plasma arc torch. Once the compact was completely melted, the vessel was moved into the pouring position again, the ingot was pulled down within the mold, and another pour was made into the mold. This cycle was completed until all of the compacts within the feeder were melted.

The resulting ingot was approximately 50 cm long. Transverse cuts were made across the ingot near the top and bottom as well as the middle of the ingot. See FIG. 6. The entire cross-section of the ingot was solid. See FIG. 7. Very small voids were found near the outside diameter of the ingot. The center of the ingot was free of voids. Other transverse cuts were made to perform chemical analyses and metallographic analyses of the various locations along the ingot that were of interest. The metallographic samples were polished and etched.

Representative photomicrographs were taken showing a fine grain microstructure. See FIG. 8. A three phase microstructure was found which is typical of this type of titanium aluminide. Evidence of large voids or casting defects were not found over the ingot cross-section. Medium size defects in the range of 100-300 micrometers were typically found near the ingot outside diameter. These would be removed during machining of the outer surface. Small voids in the range of 10-20 micrometers were occasionally found throughout the cross-section.

Example 2

Sample Operational Parameters to Make a Ti 6Al 4V Alloy Ingot

Figure 9:
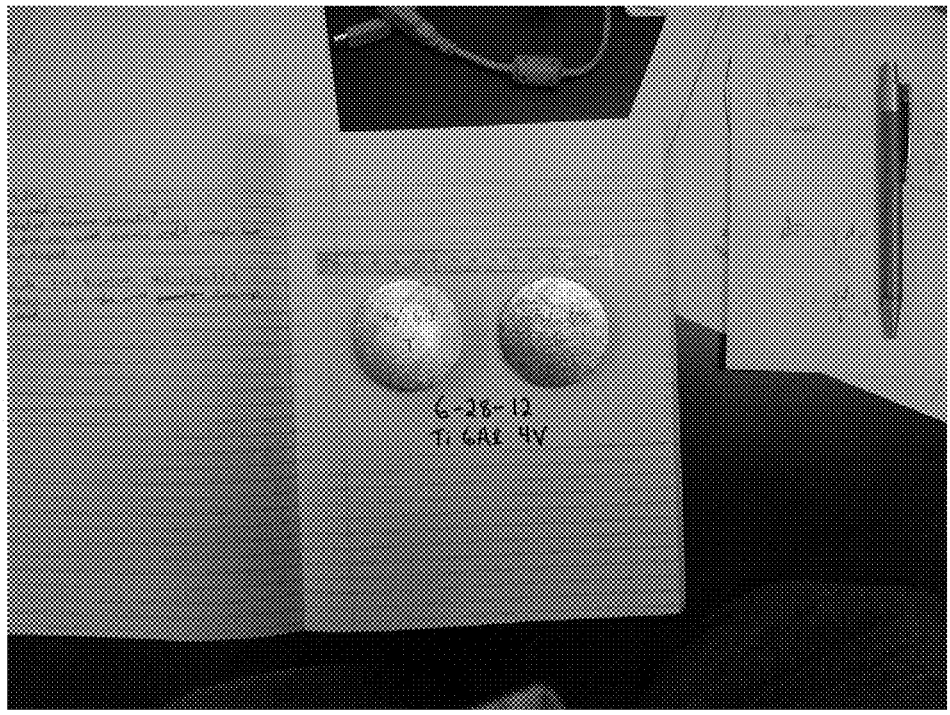
FIG. 9 is a photograph of cross-section of a 55 mm outer diameter Ti 6Al 4V ingot manufactured in accordance with another exemplary embodiment of the invention.

FIG. 9 illustrates a 55 mm outer diameter Ti 6Al 4V alloy ingot manufactured in accordance with Example 2. Pieces of a scrap 8 inch diameter ingot previously melted were cut using a band saw. The pieces were sized to fit inside the PAM-5 feeder. Other pieces were laid in the vessel to form the skull. The chamber was pumped down to less than 50 mTorr with a 5 mTorr/min rate of rise. The chamber was backfilled to about 600 Torr and the plasma arc torch started in the vessel. The contents within the vessel were melted using 600-700 Amp torch current; then the vessel was moved into the pouring position while the plasma arc torch was still operating. The molten contents of the vessel were poured into a 55 mm inside diameter water-cooled copper segmented mold. A water cooled copper plate with a dovetail groove machined into it formed the bottom of the mold. The molten material poured into the mold was allowed to solidify in the dovetail, thereby creating the means to pull the solidified ingot out of the mold upon subsequent pours. Once the initial casting of the dovetail was completed, the induction power supply to the mold was turned on to about 80 kW. A second pour from the vessel was made to fill the mold to the level where a molten pool could be maintained using the induction power. The vessel was moved to the feed position, and a cut piece was pushed into the vessel from the feeder. This piece was melted quickly by the plasma arc torch. Once the piece was completely melted, the vessel was moved into the pouring position again, the ingot was pulled down within the mold, and another pour was made into the mold. This cycle was completed until all of the scrap pieces within the feeder were melted. The resulting ingot was approximately 50 cm long. Transverse cuts were made across the ingot near the top and bottom as well as the middle of the ingot. See FIG. 9. The entire cross-section of the ingot was solid.

Example 3

Casting of titanium-aluminide (TiAl) alloys is an emerging industry with the potential to be more cost effective than forging methods. Steel mold casting has been suggested as a possible technique to process TiAl alloys into an ingot that can be machined or forged as-cast, or can be ground or remelted and atomized into powder form. This process would allow for good surface finish, higher dimensional tolerances, and a reusable mold. Testing was conducted with a titanium aluminide alloy. High temperature gradients can cause the ingot or skull to shatter violently. This thermal sensitivity makes processing and extraction of the TiAl alloy more difficult. In addition, safety precautions must be taken to prevent damage and injury. Helium (He) gas was used for the plasma torch.

Experimental Procedure

Around 6.5 kg of a TiAl alloy was loaded into the tiltable hearth 10 of the plasma arc melting system 100 to be melted by the plasma torch 12 using helium gas. DC stirring coils 18 were used to mix the elements of the molten metal in the hearth 10 to ensure homogeneous composition (See FIG. 1). Two stirring coils 18 were provided in series with one another, and disposed one above the other, as is illustrated in FIG. 1.

The stirring function is able to be turned on and off without halting the melting process using the switching cylinder 20, which creates a short that bypasses the stirring coils 18. After the melt was mixed, the hearth 10 was placed into tilting position and the torch 14 was pointed at the rear of the hearth 10 and at a far enough distance to avoid being hit by the tilting hearth 10. The hearth 10 was tilted until all liquid contents were poured out. A single pour filled the steel mold completely and then the process ended and the ingot was extracted after cooling.

Note that FIG. 1 is a DC Stirring coil schematic featuring two circuits, one that connects to the stirring coils 18 and another that connects to a plate on the switching cylinder 20 that "disconnects" the stirring coils 18 by shorting the hearth 10 to ground. The hearth is the high potential and the unillustrated chamber in which the hearth 10 is enclosed may serve as the ground. The two coils are 5 turns each with 00 gauge wire placed underneath the hearth. One of the coils is directly above the other.

Figure 10:
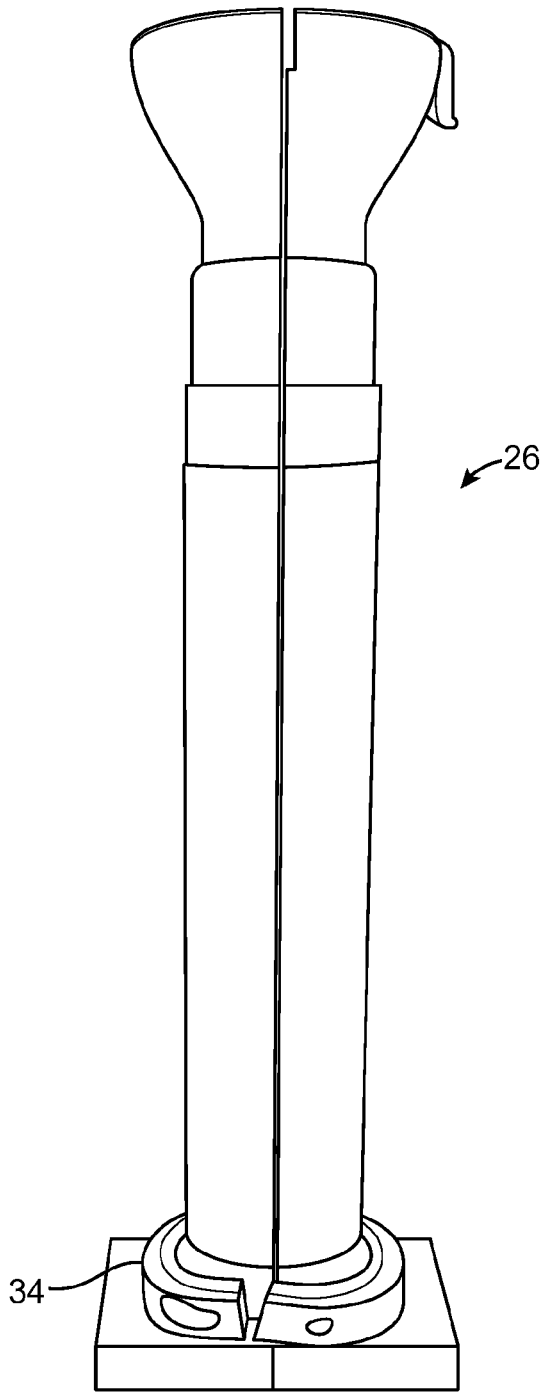
FIG. 10 is an elevation view of steel mold halves with one of two aluminum bands that can be used to hold the halves together near the top and bottom of the mold.

The steel mold (not illustrated in FIG. 1) had an inner diameter of 2" and a length of 20". Aluminum bands 34 were used to hold the two mold halves together, as is seen in FIG. 10. The interior surface finish of the mold was 125 μin. The mold had a thickness of 31/64" in the middle section, 1" bottom, and a 19/64" thick funnel. Tests were made with an unheated and a heated steel mold. The amperage and voltage supplied to the torch, time spent stirring, and induction power to the mold was recorded for later comparison (Table 1).

TABLE 1

Amperages and Stir Time for TiAl alloy Steel Mold Casting

| | Torch Current (A) | Torch Voltage (V) | Stir time (min) | Induction power (kW) |
|---|---|---|---|---|
| Cold Mold | 1200 | 160 | 3 | n/a |
| Heated Mold | 1200 | 160 | 5 | 30 |

Figure 11:
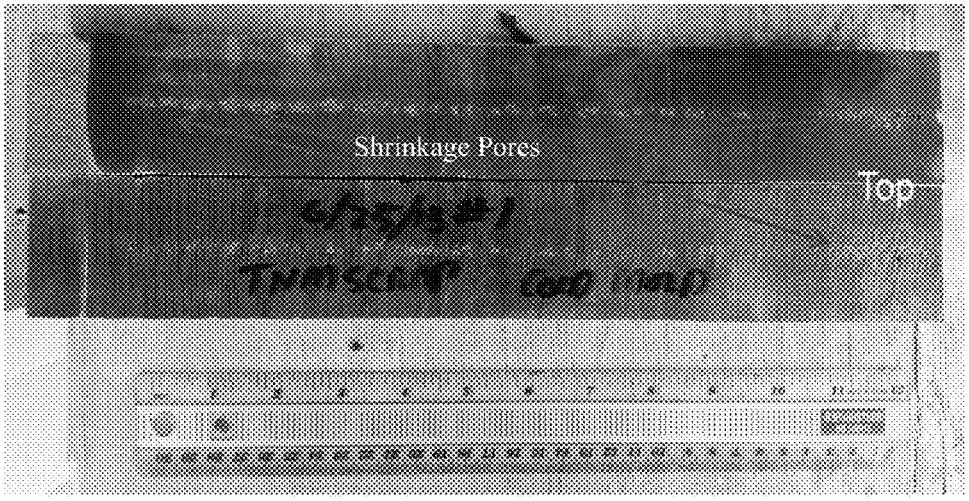
FIG. 11 is a photograph showing a longitudinal section of a titanium aluminide ingot, cast into an unheated steel mold, highlighting large amounts of shrinkage porosity at the top and near bottom of the sections. The chip on the top ingot to the left was caused by the saw.
Figure 12:
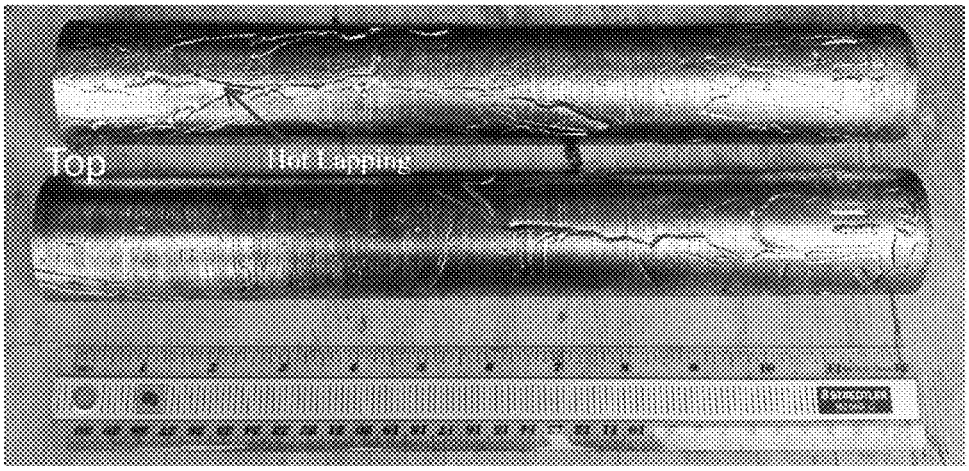
FIG. 12 is a photograph showing the surface finish of a titanium aluminide ingot, cast into a heated steel mold.

The extracted ingots were cut longitudinally using a powered saw. After sectioning, the surface finish of the ingot and the longitudinal cross-sections were inspected and photographed. The longitudinal sections of the ingots reveal shrinkage porosity along the center of the ingots (FIG. 11). Majority of the porosity can be seen at the top and near the bottom of the ingots. The second TiAl alloy ingot was poured into a heated mold. The surface of the ingot had some hot lapping at the top and middle sections (FIG. 12).

As will be understood by those skilled in the art, the present invention may be embodied in other specific forms without departing from the essential characteristics thereof. Many other embodiments are possible without deviating from the spirit and scope of the invention. These other embodiments are intended to be included within the scope of the present invention, which is set forth in the following claims.

What is claimed is:

1. A system for melting a raw material, comprising:

a vessel made of electrically conductive material, configured and dimensioned for the raw material to be introduced and melted therein;

a plasma arc torch configured to melt at least some of the raw material when the raw material is disposed within the vessel to thereby create a molten portion of the material;

a power supply configured to supply power to the plasma arc torch such that the plasma arc torch can thereby melt the raw material, wherein the power supply is a direct current power supply and the plasma arc torch is configured to use direct current to melt the material; and an inductor, physically disposed adjacent the vessel, and configured to be electrically disposed in series with the vessel in operation, wherein the inductor is not connected to any additional power source, and is configured to effect electromagnetic stirring of the molten material by interacting with a current of the plasma arc torch in operation.

2. The system of claim 1, further comprising a switch, configured to switch the system between:

a first configuration in which the inductor is in series with the vessel; and a second configuration in which the inductor is electrically bypassed and is not in series with the vessel, and wherein power to the plasma arc torch is not discontinued.

3. The system of claim 1, wherein the power supply comprises a direct current power supply and an alternating current power supply, and wherein the plasma arc torch is configured to use, simultaneously, a combination of direct and alternating current to melt the material.

4. The system of claim 1, wherein the vessel is tiltable between a first position, for receiving the raw material and having it melted therein, and a second position, for pouring at least some of the molten material out of the vessel.

5. The system of claim 4, further comprising a receptacle configured and dimensioned to receive the molten material from the vessel.

6. The system of claim 5, wherein the receptacle is a mold that comprises:

a heated, upper portion, comprising a second heat source configured to maintain the molten material in molten form; and a lower portion configured to be maintained at a temperature at which the molten material solidifies to thereby form an ingot.

7. The system of claim 4, wherein the plasma arc torch is configured to help direct the molten material out of the vessel.

8. The system of claim 4, further comprising an actuator configured to tilt the vessel between the first and second positions.

9. The system of claim 4, wherein the system is configured for the raw material to be fed into the vessel in first batches, and for the molten material to be poured out of the vessel in second batches.

10. The system of claim 1, wherein the vessel comprises copper.

11. The system of claim 1, wherein the vessel is cooled.

12. The system of claim 11, wherein the vessel is water-cooled.

13. The system of claim 1, further comprising a feeder to feed the raw material to the vessel.

14. The system of claim 13, wherein the feeder comprises a member selected from the group consisting of: a bar feeder, a bulk feeder, a hopper, and a canister.

15. A method for melting a raw material, comprising:

feeding the raw material into an electrically conductive vessel;

melting at least some of the raw material within the vessel with a plasma arc torch to thereby create a molten portion of the material;

electromagnetically stirring the molten material by using interaction of a current of the plasma arc torch with an electromagnetic field created by an inductor, physically disposed adjacent the vessel, and electrically disposed in series with the vessel; and operating a switch to switch between:

a first configuration in which the inductor is in series with the vessel; and a second configuration in which the inductor is electrically bypassed and is not in series with the vessel, and wherein the melting of at least some of the raw material is maintained.

16. The method of claim 15, wherein the inductor is not connected to any additional power source.

17. The method of claim 15, wherein melting the material with the plasma arc torch comprises supplying direct current to the plasma arc torch.

18. The method of claim 15, wherein melting the material with the plasma arc torch comprises supplying alternating current to the plasma arc torch.

19. The method of claim 15, wherein melting the material with the plasma arc torch comprises simultaneously supplying a combination of direct and alternating current to the plasma arc torch.

20. The method of claim 15, further comprising tilting the vessel to a second position to thereby pour the molten material out of the vessel.

21. The method of claim 20, wherein pouring the molten material out of the vessel comprises pouring the molten material into a receptacle.

22. The method of claim 21, wherein the receptacle is a mold, further comprising:

maintaining a top portion of the molten material in the mold in a molten state; and solidifying the molten material within a lower portion of the mold to thereby create an ingot.

23. The method of claim 22, further comprising cooling a portion of the mold near a bottom thereof.

24. The method of claim 22, further comprising heating a portion of the mold near a top thereof.

25. The method of claim 20, further comprising directing the molten material out of the vessel with the plasma arc torch.

26. The method of claim 20, wherein feeding the raw material into the vessel comprises feeding the raw material in first batches, and wherein tilting the vessel to pour the molten material out of the vessel comprises pouring the molten material in second batches.

27. The method of claim 15, further comprising cooling the vessel.

28. The method of claim 15, wherein the raw material comprises a member selected from the group consisting of titanium, zirconium, nickel, cobalt, and combinations and alloys thereof.

29. The method of claim 15, wherein the raw material comprises a member selected from the group consisting of: compacted disks, cylinders, blocks, loose material wrapped in foil, unwrapped loose material, and scrap pieces of the raw material.

* * * * *